US006587133B1

(12) United States Patent
Tjoa

(10) Patent No.: US 6,587,133 B1
(45) Date of Patent: Jul. 1, 2003

(54) IN-LINE PRINTING AND STEPWISE PROCESSING OF A BAND OF MATERIAL

(76) Inventor: Cornelis Erik Tjoa, Angelsloerdijk 38, 7822 HL Emmen (NL)

( * ) Notice: Subject to any disclaimer, the term of this patent is extended or adjusted under 35 U.S.C. 154(b) by 0 days.

(21) Appl. No.: 09/639,587

(22) Filed: Aug. 16, 2000

(51) Int. Cl.[7] ..... B41J 11/00
(52) U.S. Cl. ..... 347/172
(58) Field of Search ..... 347/172, 218–219, 347/173, 175; 226/195; 400/200; 156/354, 359, 384, 387, 388, 497, 362; 493/223; 428/352; 399/69

(56) References Cited

U.S. PATENT DOCUMENTS

| | | | | |
|---|---|---|---|---|
| 4,559,755 A | | 12/1985 | Romagnoli | |
| 5,409,441 A | * | 4/1995 | Muscoplat | 493/223 |
| 5,540,805 A | | 7/1996 | Ackley et al. | |
| 5,724,085 A | | 3/1998 | Inui et al. | |
| 5,765,481 A | | 6/1998 | Tortora et al. | |
| 5,826,513 A | | 10/1998 | Fromson et al. | |
| 5,847,742 A | | 12/1998 | Nishimura | |

OTHER PUBLICATIONS

European Search Report , re: 99202655.9–2304–.

* cited by examiner

*Primary Examiner*—Lamson Nguyen
*Assistant Examiner*—K. Feggins
(74) *Attorney, Agent, or Firm*—Altera Law Group LLC

(57) ABSTRACT

For in-line printing and processing of successive portions of a band material, the portions are each printed in a printing position (5; 157) and processed in a processing position (36; 43), both along that transport path (1; 101). The band material is advanced at least once over a predetermined distance along the transport path (1; 101) for transferring portions of the band material from the printing position (5) or the processing position, to the processing position (36; 43) or, respectively, the printing position (157). Since the printing is carried out incrementally in accordance with the incremental formation of the printing, changes in the printing from portion to portion can be implemented easily. Since each printed portion is advanced over a remaining portion of the predetermined distance after printing, it is assured in a simple manner that the printings are accurately aligned in transport direction for processing to be performed.

15 Claims, 2 Drawing Sheets

IN-LINE PRINTING AND STEPWISE PROCESSING OF A BAND OF MATERIAL

TECHNICAL FIELD AND BACKGROUND ART

The invention relates to a method according to the introductory portion of claim 1 for in-line printing and processing of successive portions of a band material. The invention further relates to a system according to the introductory portion of claim 7 and to a printer according to the introductory portion of claim 13.

Such a method, such a system and such a printer are known from U.S. Pat. No. 4,559,755. According to this document, the printing is applied by flexoprinting to a strip of packaging material, usually aluminum, which is fed along the transport path to a processing station where the packaging material is sealed to a strip of blisters. The blisters have previously been formed in a sequence of steps along another transport path. The effective length of band material between the position where the flexoprinting roll contacts the packaging material and the processing station where the backing of the blisters is sealed to the blisters containing the products to be packaged is adjustable.

In-line flexoprinting allows the backing to be printed on demand, in accordance with the amount of products being packaged and the printing can be formed as packaging material is fed to the position where it is processed and is thereby automatically aligned in transport direction with the blisters to be sealed to the packaging material.

A disadvantage of flexoprinting is that changing from one image to be printed to another image to be printed is cumbersome in that it requires changing the printer block. Moreover, for each design to be printed, a different printing block is needed which entails substantial costs per design and the need of keeping a stock of all designs one desires to be print.

SUMMARY OF THE INVENTION

It is an object of the invention to facilitate changing from one image to another in an in-line printing and processing process in which printings have to be accurately positioned in transport direction in accordance with a processing position upstream or downstream of the printing position. Further objects of the invention are to avoid the need of keeping a stock of printing blocks while alignment in transport direction between positions of printings on the band material and positions on the band material on which processing steps are performed is still assured in a simple, reliable manner.

According to the present invention, this object is achieved by providing a method according to claim 1. Another embodiment of the present invention is formed by a system according to claim 7. The present invention can also be embodied in a printer according to claim 13 which is specifically adapted to be included in a system according to claim 7 in combination with generally available processing facilities.

By providing that the printing is carried out incrementally and in conjunction with incrementally advancing the portion to be printed in accordance with the formation of the incremental portions of the printing, such that the printing is formed, changes in the printing to be made can be made easily by changing data determining the way the printing member is controlled. By further providing that the printed portion is advanced over a remaining portion of the predetermined distance after having been printed, it is assured in a simple manner that the printings are aligned with the positions on the band material onto which the processing is performed. This can be upstream or downstream of the printing position. In both cases, the predetermined total distance of displacement of the band material between the printing station and processing station assures that the printing is aligned in transport direction with the position on the band material onto which the processing step is performed when the transfer of respective portion of the band material between the printing position and the processing position is completed.

These and other objects, features, effects, advantages and details of the present invention are set forth in further detail in the dependent claims and the following description of embodiments of the invention in which reference is made to the drawings of the present application.

MODES FOR CARRYING OUT THE INVENTION

Figure 1:
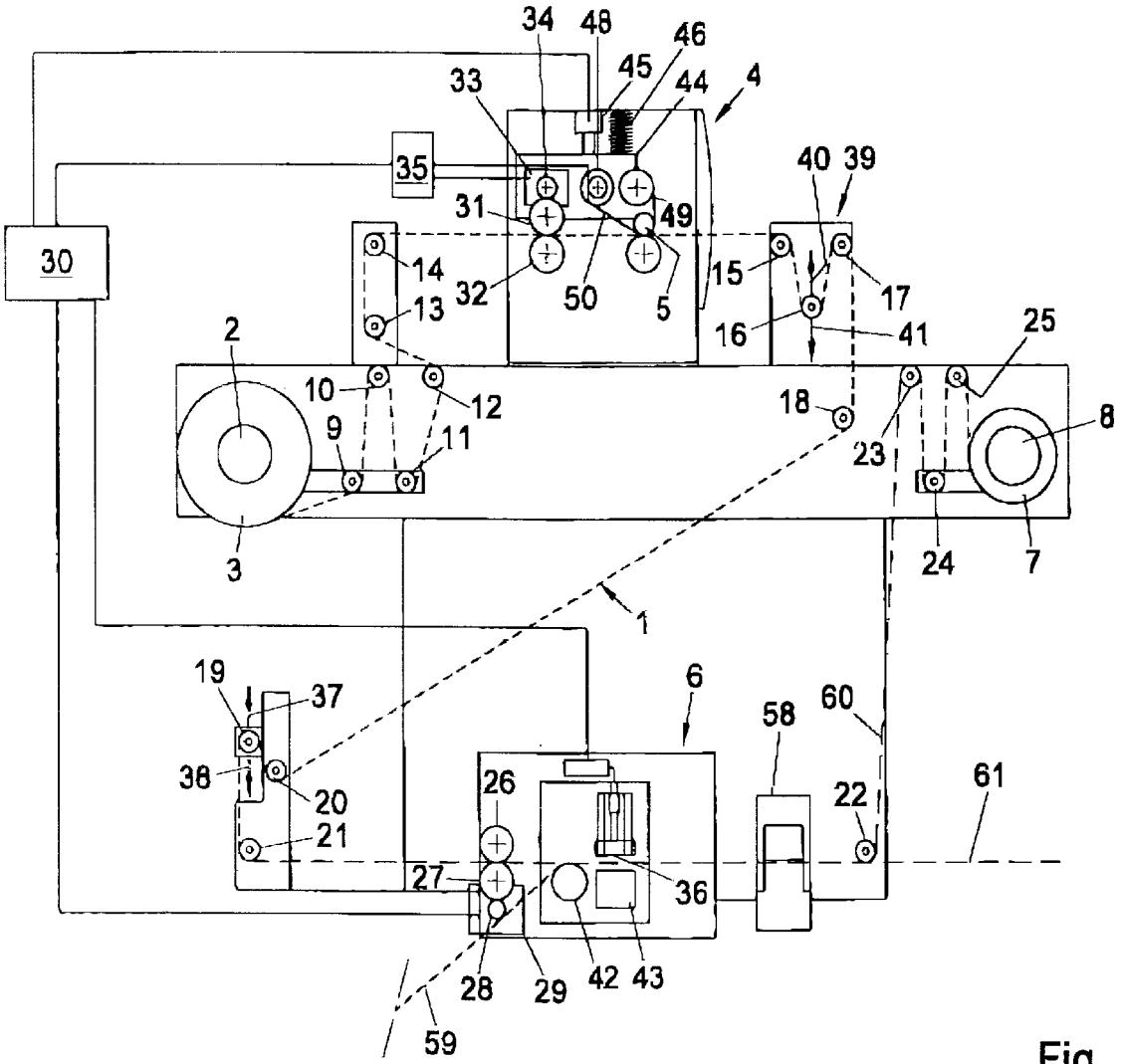
FIG. 1 is a schematic representation of a first embodiment of a system according to the present invention.

The system for in-line printing and processing of successive portions of a band material as shown in FIG. 1 forms the presently most preferred embodiment of the present invention. It is based on a combination of a commercially available packaging apparatus and a modified commercially available printer. Therefore details of the packaging apparatus and the printer are not described extensively. Both the packaging apparatus and the printer can be of various types, depending on the requirements regarding for instance size and capacity which need to be fulfilled.

A transport path 1 for transporting band material—in this example in the form of back sealing material for blister packages—extends across this system. In operation, the band material to be printed and processed extends along the transport path 1 The transport path 1 starts at a support 2 carrying a feeding roll 3, along a printer 4, a processing stations 6 and a punching station 58. Downstream of the punching station 58, the band material splits up in a band 60 of remaining material which is left over after packages have been punched out at the punching machine 58 and a line 61 of blister packages. The band 60 of remaining material extends to a collecting roll 7. The collecting roll 7 is carried by a collecting roll support 8 including a drive for pulling band material along the track 1.

The printer 4 includes a printhead 5 along the transport path 1.

In this example, the processing station is formed by a sealing station 6. The course of the transport path 1 is determined by a plurality of guide rolls 9–25. Some of the guide rolls are arranged for performing other functions than guiding the band material as well, as is described below. Particularly suitable materials for the band of back sealing material are aluminum alloys, which stretch little under tension and also show relatively little extension and shrinkage under influence of temperature and humidity. Furthermore, aluminum alloy film is a very effective barrier material.

For advancing band material along the transport path, an advancing structure is provided. The most upstream part of the advancing structure is formed by the support 2 of the feeding roll 3, which is provided with a friction brake (not shown) to keep the portion of the band material upstream of the printer 4 tensioned.

The next part of the advancing structure is formed by a pair of rollers 31, 32 of the printer 4. The roller 31 is connected to a motor 33 via a transmission wheel 34. In turn, the motor 33 is operatively connected to a printer control system 35 adapted to control the motor 34 for rotation in accordance with the progress of the printing process carried out by the printhead 5. This printhead 5 is adapted and controlled for incrementally printing successive line portions of a printing to be made. The printhead 5 is operatively connected to the printer control system 35 as well. The printer control system 35 is adapted for controlling the printhead 5 and the motor 33 in a coordinated manner such that images are formed in accordance with instructions obtained from a control system 30 connected thereto. Suitable printer engines operating in accordance with this principle are commercially available in various forms, such as in the form of laser printers, matrix printers and ink jet printers. Therefore, the printer 4 is not described in detail. According to the present example, the construction of the printer 4 is based on a thermal printer commercially available from TEC Corporation, 570 Ohito, Ohito-cho, Tagata-Gun, Shizuoka-ken 410-23, Japan.

The next part of the advancing structure forms a feeder structure.of the sealing station 6. The feeder structure of the sealing station 6 includes transport rollers 26, 27 and a motor 29 to which the transport roller 27 is connected via a transmission wheel 28. In turn, the motor 29 is connected to the control system 30 for stepwise feeding material to the sealing station 6 in response to activation signals received from the control system 30. More in particular, this control system 30 is adapted to activate the motor 29 for rotation over a predetermined angle, each time the band of material is to be shifted forward one position for bringing a new portion of the band material in a position to be processed in the sealing station 6. This distance is preferably adjustable in accordance with the displacement required by the.sealing steps to be performed at the sealing station 6—for instance in accordance with the size in transport direction of the packages to be sealed. An example of such a sealing station is described in U.S. Pat. No. 4,559,755.

The collecting roll support 8 forms the most downstream portion of the feeder structure and is adapted for keeping the band material tensioned downstream from the pair of transport rollers 26, 27 in the sealing station 6.

The minimum effective length of the band material between the printhead 5 and a sealing tool 36 in a sealing position in the sealing station 6 is adjustable by adjusting the position of roller 19 in the direction of the arrows 37, 38 in order to adjust the length of a loop of band material extending over that roller between the printer 4 and the sealing station 6. By adjusting this effective minimum length, it can be assured that the processing at the sealing station 6 is each time carried out on a portion of the band material aligned in transport direction with a printing printed on the band material by the printer 4.

The printer 4 is equipped with a printhead carrier 44 which is tiltable anti-clockwise about an axis coaxial with the axis of the roller 31 by a solenoid 45 against the action of springs 46. The solenoid 45 is connected to and controlled by the control system 30 In addition to the printhead 5 formed by a thermal printing element, the printhead carrier 44 carries the transmission wheel 34, the motor 33 as well as a printing ribbon 50 extending from a feeding spool 48 to a collecting spool 49.

Between the printer 4 and the sealing station 6, a buffer station 39 is arranged. In this buffer station 39, a central roller 16 is suspended between a roller 15 directly upstream of the central roller and a roller 17 directly downstream of the central roller 16, such that its axis is movable in the direction of arrows 40, 41, i.e. essentially transverse to the orientation of the band material when tensioned straight between upstream and downstream rollers 15, 17. The tension in. the band material exerted by the central roller 16 is smaller than the force exerted onto the band material due to friction exerted by the feed roll. support 2. Thus, band material upstream of the central roller 16 is not advanced through the printer by the tensioning action of the central roller 16. Band material upstream of the central roller 16 is advanced only if actively driven by the transport rollers 31, 32 of the printer 4 or by the transport rollers 27, 28 of the sealing station 6.

The sealing station 6 is further equipped with a roller 42 upstream of the sealing tool 36, where a strip of blister shells 59 meets the band of back sealing material extending along the transport path 1. Back sealing material in the transport path 1 and blisters carrying products to be packaged which are advanced together from the roller 42 can be sealed together by the sealing tool 36. Side edges of the blisters and the back sealing material are trimmed to a common contour in the punching station 58. It is also possible to carry out sealing and punching in a single, suitably adapted station or to dispense with punching and to individualize packages by for instance cutting off the sealed back sealing and blister material in suitable positions.

Operation of the system according to this example consists of a repetition of the following phases for each completed package or set of packages.

During one of these phases, which follows the completion of a package or a set of packages at the sealing station 6, the printhead carrier 44 is in a lifted position, i.e. the printhead 5 and the ribbon 50 are in a position disengaged from the back sealing material in the transport path 1. A last printed line of a printing just formed by the printhead 5 is at the position of the printhead 5. Slack in the band material between the printer 4 and the sealing station 6 is at its maximum and forms a loop in the buffer 39. The band material is retained under some tension by the weight of the central, movable roller 16 of the buffer station 39. The sealing tool 36 is in apposition spaced from the anvil 43 and a sealed blister package just sealed and trimmed by the sealing tool 36 is still in the sealing position. A sealed and punched package is in a punching position in the punching station 58. The transport rollers 25, 28 are in frictional engagement with the strip of back seating material in the transport path 1. The portions of the band material and the strip of blister shells downstream of the transport rollers 27, 28 of the sealing station 6 are retained in tensioned condition by the, collecting roll support 8 exerting a torque onto the collecting roll 7.

During a succeeding phase, the motor 29 for driving the transport rollers 27, 28 of the sealing station 6 is activated to advance the back sealing material in the transport path 1 over a predetermined distance. This distance is set in accordance with the pitch of successive blister shells of the strip of blister shells 59 fed to the sealing station 6. As the band material is advanced by the rollers 25, 27, the portion of the band material downstream of the rollers 25, 27 is kept tensioned by the torque exerted by the collecting roll support 8 carrying the collecting roll 7. Since the strip of blisters 59 is sealed to the band material at and downstream of the sealing station 6, the strip of blisters 59 is entrained over the same distance as the band material. Thus, the band material is advanced by the rollers 27, 28 until a new portion of band material and a new blister shell are in a sealing position in the sealing station 6.

Instead of controlling the predetermined distance over which the band material is advanced by controlling the angle over which the motor 29 is rotated, it is also possible to control this predetermined distance by driving the motor 29 uncil it is sensed that a next blister shell has reached the sealing position in the sealing station 6, thereby avoiding rams due to for instance slip between the transport rollers 27, 28 and the material between these rollers 27, 28, manufacturing tolerances in the strip of shells and/or insufficient precision of the feeder structure of the sealing station 6.

As the back sealing material in the area of the sealing station 6 is advanced over the predetermined distance driven by the rollers 27, 28, initially material between the buffer station 39 and the sealing station 6 follows while band material at the printer 4 remains stationary and the amount of slack in the back sealing material in the transport path 1 between the printer 4 and the sealing station 6 is reduced. This entails a reduction of the size of the loop causing the central roller 16 to be lifted to an uppermost position in which the length of back sealing material in the transport path 1 between the printer 4 and the sealing station 6 has reached a predetermined minimum.

After the loop in the buffer station 39 has reached its minimum size, the remainder of the advancement of the band material under control of the rollers 25, 27 of the sealing station 6 causes band material upstream of the buffer station 39 to be entrained as well, until the advancement of band material over the aforementioned predetermined distance has been completed. Thus, back sealing material is advanced through the printer 4 under control of advancing members other than the advancing members 31, 32, 33 of the printer 4. The band material upstream of the rollers 25, 27 of the sealing station is held tensioned by the friction exerted by the support 2 of the feeding roll 3.

Since the length of band material between the printhead 5 and the sealing position is constant, the position of band material in the printer 4 after the advancement by the rollers 25, 27 of the sealing station 6 is controlled by the advancing members 25, 27 of the sealing station 6.

By adjusting the minimum length of the band material between the printhead 5 and a sealing tool 36 in a sealing position in the sealing station 6, it can be ensured that each printing printed at the printer 4 is properly aligned transport direction with the sealing tools 36, 43 when it reaches the sealing position in the sealing station 6. To effect this adjustment, the position of the adjustable roller 19 is adjusted accordingly. It is also possible to adjust this minimum length in various other manners, such as by adjusting the position of the printer 4 or by adjusting the topmost position of the central roller 16 of the buffer station 39 and/or the position of other rollers 15, 17 of the buffer station 39.

During the next phase, the rollers 25, 27 of the sealing station 6 are held stationary and the sealing tool 36 is operated to seal back sealing material to a blister shell and to trim the package to the desired shape.

Also during this phase, the printhead carrier 44 of the printer 4 is lowered and the printhead 5 is operated in conjunction with the motor 33 to incrementally print the desired image on the back sealing material in accordance with control signals received from the printer control system 35. The band material is advanced through the printer 4 under control of the motor 33. In turn, the motor 33 is controlled by the printer control system 35 in accordance with the formation of the incremental line portions of the printing by the printhead 5, to advance the bandmaterial such that the desired image is formed.

As band material is advanced through the printer 4, slack in the band material between the printer 4 and the sealing station 6 is stored in the buffer station 39 by increasing the size of the loop of band material extending over the central roller 16. Finally, the printhead carrier 44 is lifted again, so that the printhead 5 is again disengaged from the band material in the transport path 1.

By lifting the printhead 5 from the band material, the thermal printhead 5 is disengaged from the band material cach time before the advancement of each printed portion offer the remaining portion of the predetermined distance under control of the advancing drive associated to the sealing station 6. Thus, the relatively quick advancement of the band material through the printer 4 over a remaining portion of the predetermined distance after having been printed, does not have to overcome friction exerted by the printhead 5 and does not entail that printing ribbon is spooled through accordingly. Moreover, wear of or even damage to the printhead 5 during advancement under control of the advancing drive associated to the sealing station 6 can be reduced.

With the completion of this phase, one operating cycle of printing back sealing material for one blister package ox set of blister packages and of sealing a more downstream blister package or set of blister packages has been completed. A next operating cycle starts with the phase which has been described first. After a number of such operating cycles, the portion of the band material carrying the image printed during the described operating cycle reaches the sealing position and a blister package is sealed with that portion of the band material carrying the printed image.

Images to be printed can for instance include or be limited to indicia designating the contents of the package to be formed, such as the type of contents and indications regarding the order of taking in of pills or capsules in the event of multi-cavity blister shells. Since the printhead 5 is adapted for incrementally generating successive portions of a printing to be printed, and the feeder structure is adapted for advancing band material relative to the printhead 5 in accordance with the formation of the incremental portions of the printing, the image,to be printed can easily be changed, even per operating cycle. For instance sequences of each time two or more blister packages can be produced which carry different printings. This is for instance advantageous for packaging anti-conception pills which need to be taken in a predetermined order, since it allows to print each of a sequence of blisters containing pills to be taken over a longer period, for instance three months, with numbers designating the prescribed taking order (per pill and per blister) and with indications of the respective days of the week on which each pill is to be taken, the latter facilitating verification which pills have been taken.

In the system according to the present example, slack in the band material between the sealing position 36, 42 and the printing position 5 which is formed during printing can be accommodated. This slack is eliminated each time after completion of printing one of the portions and directly before the advancement of the portion over the remaining portion of the predetermined distance. Moreover, the formation of slack in the band material allows to print on the band material while incrementally advancing the band material at the printing position 5 while the band material is stationary in the more downstream sealing position at the tools 36, 43 as it is being sealed.

The system according to FIG. 1 includes separate advancing drives of the printer 4 and of the sealing station 6. This is advantageous for accurately controlling the incremental advancement of band material at the printer 4 and allows to use conventional combinations of advancing drives, printing members and printer control systems. The advancement over the remaining portion of the predetermined distance after printing is each time carried out by an advancing drive 25, 27, 28, 29 associated to the sealing station 6 including the sealing position at the tools 36, 43. With this advancement a new portion to be sealed of the back sealing material is brought in position. That this is carried out by the advancing drive 25, 27, 28, 29 associated to the sealing station 6 provides the advantage that the new position of a blister shell or set of blister shells can be controlled accurately and that this advancing drive is used for its normal purpose, so that very little or no adaptation of a standard advancing drive is necessary to make it perform this function. Moreover, by controlling the advancement required to bring the next blister shell or set of blister shells in position by an advancing drive other than that of the printer 4, also the advancing drive of the printer 4 needs no or very little adaptation from a standard advancing drive of a printer.

The advancing drive 31–34 of the printing station 4 includes a one-way freewheel clutch allowing the rollers 31, 32 to be entrained freely in transport sense and thereby allowing band material to be entrained virtually freely in transport direction past the rollers 31, 32.

Since in the system according to the present example, the printing station 4 is arranged upstream of the sealing station, each of the portions is printed, subsequently transferred from the printing position to the sealing position, and subsequently processed in the sealing position. This allows to build up a buffer of material during printing while the band material is stationary further downstream at the sealing station 6 and to remove the buffer and to advance the band material further over the predetermined distance by pulling the band material in the direction of the sealing station 6.

Figure 2:
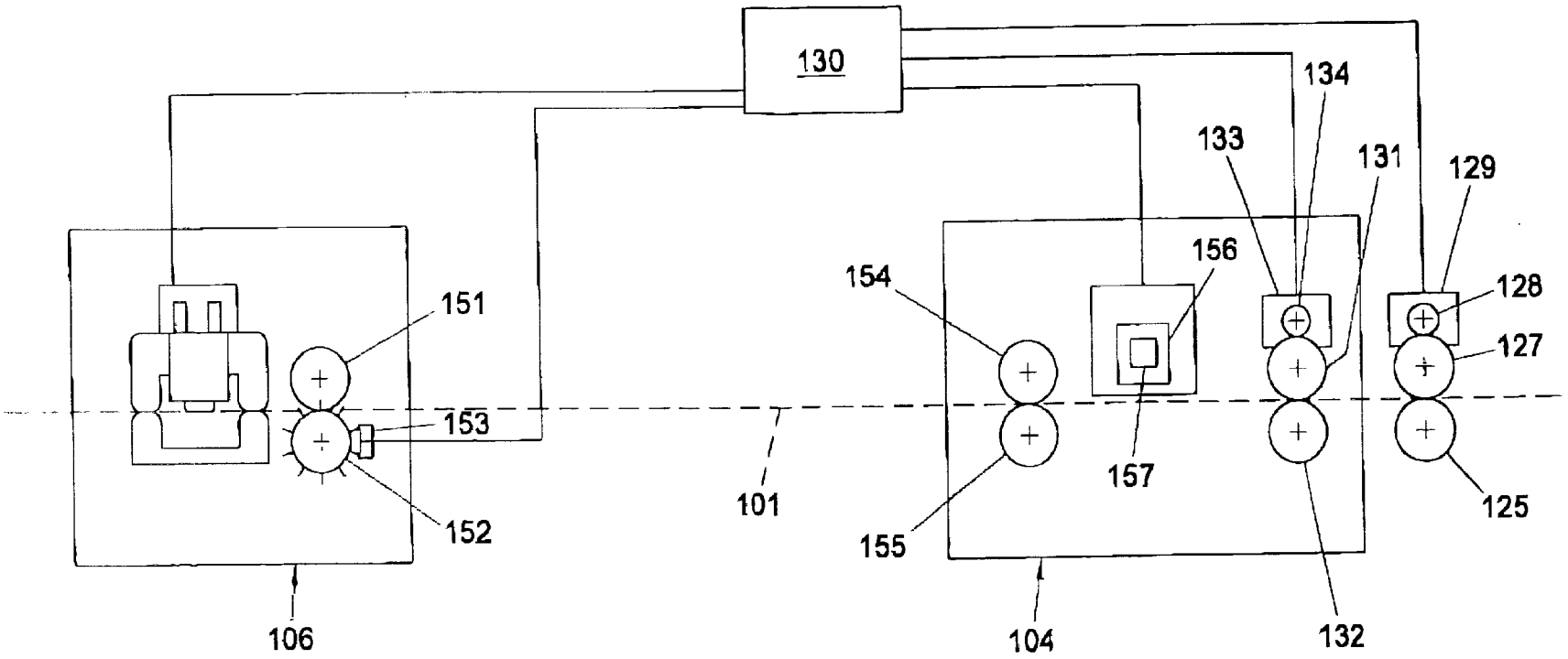
FIG. 2 is a schematic representation of a second embodiment of a system according to the present invention.

However, as is illustrated by the example shown in FIG. 2, it is also possible to provide that the printing station 104 is arranged downstream of a processing station 106 for strokewise processing of material in a strip extending through both the processing station 106 and the printing station 104. In this example, the processing station 106 is provided with a pair of rollers 151, 152 of which one roller 152 is a sprocket wheel engaging in perforations of strip material in the transport path 101. For sensing rotation of the sprocket wheel 152, a sensor 153 is provided which is connected to a control system 130.

In the printing station 104 a pair of guide rollers 154, 155 is provided. Downstream of the guide rollers 154, 155 an ink jet printhead 156 is arranged on a rail 157 transverse to the transport track 101. The printhead 156 is connected to the control system 130 as well. For incrementally advancing the band material during printing, the printing station 106 is provided with an advancing drive including rollers 131, 132 and a motor 133 coupled to one of the rollers 131 via a transmission wheel 134.

Downstream of the printing station a further portion of the total advancing structure is located in the form to a feeder drive with rollers 125, 127 for engaging band material in the transport track 101 and a motor 129 coupled to one of the rollers 127 via a transmission wheel 128. The motor 129 is operatively connected to the control system 130 for advancing the band material one processing position of the processing station 106 during each operating cycle.

In operation, each time after a stroke of the processing station 106 is completed, the band material is released by the processing station 106 and incrementally transported under control of motor 134 and the rollers 131–133 of the printing station 104 as the image to be printed is built up by the printing head 157. In the meantime advancement of the band material is sensed by the sensor 153 sensing rotation of the sprocket wheel 152.

When the printing is completed, the band material is transported further under control of the advancing drive formed by the motor 129, the transmission wheel 128 and the rollers 125, 127 until the sensor 153 indicates that the band material has been transported over the preset distance. Then a next stroke is carried out by the processing station 106, followed by a next printing operation carried out by the printing station 104.

In this example, the length of band material between the printing station 104 and the processing station 106 is always constant and the band material is alternatingly printed and processed. However, it is also possible to build up a buffer loop or the like of material each time after processing at the processing station 106, which buffer loop is gradually consumed during printing and pulled away each time after printing, under control of the motor 129, the transmission wheel 128 and the rollers 125, 127 downstream of the printing station 104. This would provide the advantage that printing can be carried out simultaneously with processing while the band material is stationary at the processing station 106.

It will be apparent to the skilled person that the present invention can be carried out in many other ways than those described above. For instance, the control system. controlling the printer can be adapted for controlling the drive associated to the printing station to disengage from the band material during the advancement of the band material under control of the advancing drive associated to the sealing station. This provides the advantage that the advancement of the band material under control of the advancing drive of the sealing station is not disturbed by the drive of the printing station which would otherwise need to be suddenly entrained by the band material when the slack at the buffer station has been pulled out of the band material. Another advantage of disengaging the advancing drive of the printing station from the band material while it is being advanced by the advancing drive of the sealing station is that the advancing drive of the printing station does not have to be adapted to be entrained by the driving effect of another drive, so that for instance no clutch in the advancing drive of the printing station is needed.

What is claimed is:

1. A method for in-line printing and processing of successive portions of a band material extending along a transport path, comprising:

printing onto each of the portions in a printing position along the transport path;

processing each of the portions in a processing position along the transport path; and stepwise advancing at least a section of the band material at least one time over a predetermined distance along the transport path for transferring at least one of the portions from the printing position or the processing position, to the processing position or, respectively, the printing position; wherein printing onto each of the portions further comprises:

incrementally generating successive portions of a printing to be printed by a printing member and incrementally advancing each respective one of the portions in accordance with formation of the incremental portions of the printing such that the printing is formed, wherein the incremental advancements during printing occur between stepwise advancements of the band material over a predetermined distance, the incremental advancements being smaller than the stepwise advancements; and each printed portion is advanced over a remaining portion of the predetermined distance after having been printed.

2. The method according to claim 1, wherein slack in the band material between the processing position and the printing position is formed or reduced during printing, and eliminated each time after completion of printing one of the portions.

3. The method according to claim 1, wherein the printing is generated thermally via a thermal printhead, the printhead being brought in a position spaced away from the band material each time before advancement of each printed portion over the remaining portion of the predetermined distance.

4. The method according to claim 1, wherein each of the portions is subsequently printed at the printing position, transferred to the processing position, and processed in the processing position.

5. The method for in-line printing and processing of successive portions of a band material extending along a transport path, comprising:

printing onto each of the portions in a printing position along the transport path;

processing each of the portions in a processing position along the transport path; and stepwise advancing at least a section of the band material at least one time over a predetermined distance along the transport path for transferring at least one of the portions from the printing position or the processing position, to the processing position or, respectively, the printing position; wherein printing onto each of the portions further comprises:

incrementally generating successive portions of a printing to be printed by a printing member and incrementally advancing each respective one of the portions in accordance with the formation of incremental portions of the printing such that the printing is formed, wherein the incremental advancements during printing occur between stepwise advancements of the band material over the predetermined distance, the incremental advancements being smaller than the stepwise advancements; and each printed portion is advanced over a remaining portion of the predetermined distance after having been printed, wherein the advancement of the portions in accordance with the incremental formation of the printing, is controlled by a print advancing drive associated to a printing station including the printing position, and wherein the advancement of at least one portion over the remaining portion of the predetermined distance after having been printed is carried out by a feeder structure associated to a processing station including the processing position for feeding a next portion to be processed to the processing position.

6. The method according to claim 5, wherein a print advancing drive associated to the printing station is disengaged from the band material during advancement of the band material under control of the feeder structure.

7. A system for in-line printing and processing of successive portions of a band material, comprising:

a transport path for transporting band material extending along the transport path;

a printing structure including a printing member along the transport path;

a processing structure along the transport path; and an advancing structure for stepwise advancing at least one portion of the band material at least one time over a predetermined distance along the transport path such that at least one portion of the band material is transferred from the printing structure or the processing structure, to the processing structure or, respectively, the printing structure; wherein the printing member is adapted for incrementally printing successive portions of a printing; and the advancing structure is adapted for incrementally advancing at least one portion of the band material relative to the printing member in accordance with the incremental formation of the printing such that the printing is formed, wherein the incremental advancements during printing occur between stepwise advancements of the band material over the predetermined distance, the incremental advancements being smaller than the stepwise advancements, and for subsequently advancing at least one printed portion over a remaining portion of the predetermined distance after having been printed.

8. The system according to claim 7, wherein the transport path includes a section between the printing structure and the processing structure for accommodating slack in the band material between the processing position and the printing position.

9. The system according to claim 7, wherein the printing structure comprises a thermal printhead moveable between a first position close to the transport path for directly or indirectly engaging band material extending along the transport path and a second position spaced from the transport path for releasing band material extending along the transport path.

10. The system according to claim 7, wherein the printing structure is arranged upstream of the processing structure.

11. A system for in-line printing and processing of successive portions of a band material, comprising:

a transport path for transporting band material extending along the transport path;

a printing structure including a printing member along the transport path;

a processing structure along the transport path; and an advancing structure for stepwise advancing at least one portion of the band material at least one time over a predetermined distance along the transport path such that at least one portion of the band material is transferred from the printing structure or the processing structure, to the processing structure or, respectively, the printing structure; wherein the printing member is adapted for incrementally printing successive portions of a printing; and the advancing structure is adapted for incrementally advancing at least one portion of the band material relative to the printing member in accordance with the incremental formation of the printing such that the printing is formed, wherein the incremental advancements during printing occur between stepwise advancements of the band material over the predetermined distance, the incremental advancements being smaller than the stepwise advancements such that the printing is formed, and for subsequently advancing at least one printed portion over a remaining portion of the predetermined distance after having been printed, wherein the advancing structure includes a print advancing drive for incrementally advancing at least one portion in accordance with the incremental formation of the printing, such that the printing is formed, and a feeder structure, separate from the print advancing drive, for advancing at least one portion over the remaining portion of the predetermined distance after having been printed.

12. The system according to claim 11, wherein the print advancing drive is disengageable from the band material and operatively connected to a control system adapted for controlling the print advancing drive to disengage from the band material during the advancement of the band material under control of the feeder structure.

13. A printer for printing on a band of material, comprising:

a transport path extending through the printer for advancing band material through the printer, a printing member in a position along the transport path for printing onto band material extending along the transport path, and a control means for controlling the printing member, wherein the printing member is adapted for incrementally generating successive portions of a printing to be printed;

further comprising a print advancing drive adapted for incrementally advancing each respective one of the portions relative to the printing member in accordance with the incremental formation of the printing, such that the printing is formed, the print advancing drive allowing advancement of the band material along the transport path under control of a means other than the advancing structure.

14. The printer according to claim 13, wherein the print advancing drive is adapted to control advancement of band material along the path in a first operating condition and for releasing band material extending along the path in a second operating condition.

15. The printer according to claim 13, wherein the print advancing drive is adapted to engage band material extending along the transport path in a first operating condition and for remaining disengaged from band material extending along the transport path in a second operating condition.

* * * * *